United States Patent [19]

Hajek

[11] 4,406,224

[45] Sep. 27, 1983

[54] INK THROUGH AND DOCTOR BLADE ASSEMBLY FOR PRINTING MACHINES

[75] Inventor: Josef Hajek, Friedberg, Fed. Rep. of Germany

[73] Assignee: M.A.N.-Roland Druckmaschinen Aktiengesellschaft, Offenbach am Main, Fed. Rep. of Germany

[21] Appl. No.: 269,635

[22] Filed: Jun. 2, 1981

[30] Foreign Application Priority Data

Jun. 28, 1980 [DE] Fed. Rep. of Germany ..... 3024557

[51] Int. Cl.[3] ..... B41F 1/46

[52] U.S. Cl. ..... 101/363; 101/365

[58] Field of Search ..... 101/365, 350, 351, 207, 101/208, 169, 148, 157, 363, 364

[56] References Cited

U.S. PATENT DOCUMENTS

| | | | |
|---|---|---|---|
| 375,126 | 12/1887 | Clark | 101/365 |
| 1,112,412 | 9/1914 | Adam | 101/365 |
| 2,351,315 | 6/1944 | Barber | 101/365 |
| 3,186,339 | 6/1965 | Turner et al. | 101/169 X |
| 3,566,787 | 3/1971 | Moos | 101/350 X |
| 3,611,928 | 10/1971 | Kaneko | 101/365 |
| 3,958,509 | 5/1976 | Murray et al. | 101/350 X |

FOREIGN PATENT DOCUMENTS

| | | | |
|---|---|---|---|
| 503372 | 5/1954 | Canada | 101/365 |
| 1053530 | 10/1959 | Fed. Rep. of Germany . | |

*Primary Examiner*—Edgar S. Burr
*Assistant Examiner*—Charles A. Pearson
*Attorney, Agent, or Firm*—Frishauf, Holtz, Goodman & Woodward

[57] ABSTRACT

To permit easy cleaning of an ink trough, for example upon change of color or type of ink for an offset printing machine, the ink trough is formed with a cross rail to which the doctor blade engaging the ink duct roller from below is attached. The structure includes a pivotable holding rail positioned below and beneath the doctor blade, and means to hold the holding rail in position against the cross rail, the ink zone adjustment screws passing through and being retained by the holding rail. Upon loosening of the attachment means, the holding rail and with it the adjustment screws and possibly an override cross strip and its adjustment screws are pivoted away from the doctor blade, which will become unstressed, thus leaving a gap between the end of the doctor blade and the duct roller, preferably not less than 1 cm wide, to permit ink to drain out of the trough, for example into a receiving vessel.

6 Claims, 3 Drawing Figures

INK THROUGH AND DOCTOR BLADE ASSEMBLY FOR PRINTING MACHINES

The present invention relates to printing machines, and more particularly to an ink trough and doctor blade assembly therefor.

BACKGROUND

Offset printing ink is quite thick; frequently, therefore, doctor blade arrangements which permit application of an ink film to a duct roller are so placed that the doctor blade bears against the lower portion of a duct roller, and is confined by the duct roller, the doctor blade, and additional structural elements of the inking system, for example a cross rail and side walls to define, in combination with the duct roller, an ink trough. Inking systems of this type are known in the literature, see, for example, U.S. Pat. No. 3,611,928, to which German Pat. No. 1,943,130 corresponds and German Pat. No. 1,053,530. The German Pat. No. 1,053,530 discloses an arrangement in combination with an ink trough in which a doctor blade can be placed more or less against an ink duct roller by a rail extending parallel to the ink duct roller. The thickness of the ink film can thus be changed, while retaining the setting in individual zones as controlled by the adjustment screws. To clean the ink trough, for example in order to remove ink to replace it with ink of a different color, or generally for cleaning and maintenance, it is necessary to tilt the entire ink trough. It is known that fixed ink troughs are difficult to clean since the ink has to be removed with scrapers or with blade-like tools. Tipping the entire trough arrangement facilitates emptying the ink trough, but requires substantial force since the ink trough and the associated apparatus are heavy. Entirely apart from the handling difficulty due to the weight, spilling or contacting ink-coated parts can hardly be avoided, so that the general danger of soiling makes the task of cleaning disagreeable and difficult. Additionally, removal of ink by scooping out ink from a trough, even with a blade-like tool, is very time-consuming.

The Invention

It is an object to provide an inking system, particularly for offset printing machines using thick, highly viscous ink, which permits emptying of the ink trough without the problems associated with prior art structures, and which permits retaining the ink trough in position so that it, as such, need not be moved; and, additionally, which preferably also does not require changing of positioning of the doctor blade adjustment screws so that a setting which was once made can be reproducibly reestablished after cleaning and removal of ink.

Briefly, a holding rails is provided, extending parallel to the to the duct roller, the holding rail being releasably attached to the cross rail, for example capable to pivot with respect thereto. The blade adjustment screws are secured to the holding rail so that, upon pivoting of the holding rail, the blade adjustment screws are tipped away from engagement with the doctor blade, which is located below the duct roller. Tipping away the holding rail will then leave a gap between the blade and the duct roller through which the ink can flow out. Preferably, a deflecting shield is provided, so that the ink will be directed to flow into an ink trough or ink container for re-use.

An overriding engagement rail may be provided to set a minimum gap or nip between the doctor blade and the duct roller, also adjustable by adjustment screws, which are likewise attached or connected to the cross rail, so that they, also, will tip together with the cross rail and the zone adjustment screws.

The arrangement has the advantage that, by merely loosening the attachment elements of the holding rail, it can be completely pivoted away so that the doctor blade, which is previously tensioned by the adjustment screws, is entirely released from tension and can then form a gap in the order of between about 1 to 2 cm between the doctor blade and the ink duct roller, permitting rapid outflow of the highly viscous printing ink. The ink trough or ink holder can then readily be cleaned. This is particularly important in printing machines which require frequent change in ink color. If it is only necessary to move the doctor blade by a small degree, for example to clean the edge portion of the doctor blade, a minor movement of the doctor blade may be sufficient. The zone screws need not be changed to effect such minor movement, so that, after cleaning, the zone adjustment will be reproducibly insured.

The deflection angle of the doctor blade, for example in the order of about 20°, between the doctor blade and the carrying rail therefor, provides for good separation of the inking zones due to the bending properties of the doctor blade. Bend-through of portions of the doctor blade where the adjustment is not desired or not controlled by the screws themselves can be eliminated due to the substantial bias placed against the doctor blade. Uncontrolled, usually undulating deflection of the doctor blade, upon adjustment of only lightly biased or tensioned doctor blades, results, at times, in uncontrolled bending within various ink zones so that the doctor blade will bend even in portions where it is not desired that it do so, or in a direction which is not desired, so that the actual position of the doctor blade will then not be as commanded or controlled by the adjustment screws due to skipping of an adjustment position caused by the springiness of the doctor blade itself.

The arrangement has the further advantage that scale rings, stops, and the like, can be used so that the zone adjustment screws can be reproducibly positioned. Positioning can be manual or by remotely controlled positioning motors, which can likewise be secured to the holding rail.

The system can be used with subdivided, multi-part ink troughs in which various ink trough portions may have differently colored ink, or ink of different characteristics; the holding rails can then be subdivided to be individually pivotable, corresponding to the individual sections, thus permitting individual cleaning of the various ink compartments.

DRAWINGS

Figure 1:
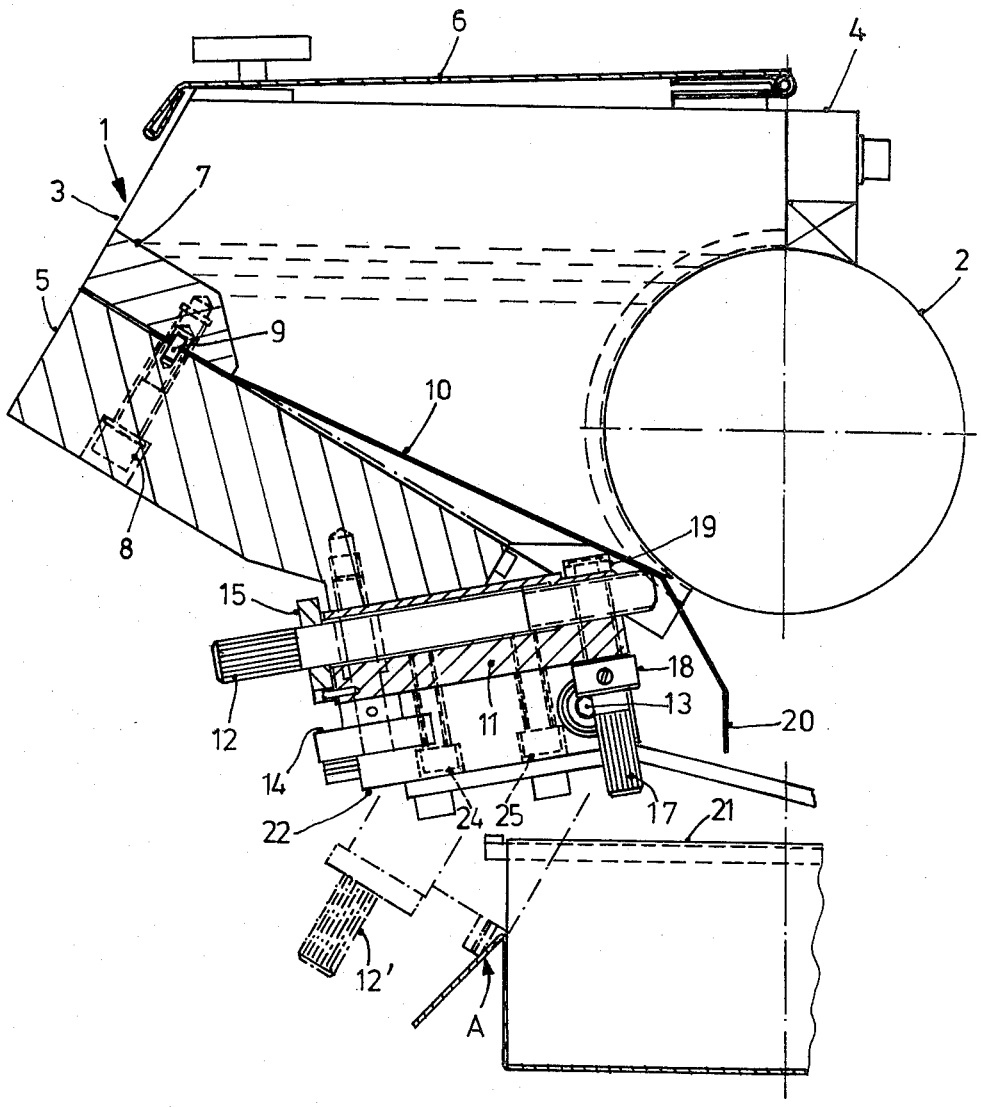
FIG. 1 is a transverse sectional view though an inking trough in accordance with the invention.

The ink trough or ink container 1 (FIG. 1) is associated with an ink duct roller 2 in such a manner that the right side—referring to FIG. 1—forms the closing side of the ink trough. Two lateral side portions 3 close off the ink trough at the sides. Sealing elements including ink stripping flaps 4 are located at the sides to prevent uncontrolled escape of ink. The lower side of the ink trough is formed by an inclined cross rail 5. The ink trough is filled with viscous offset printing ink, as schematically shown, and to prevent contamination or the dropping of objects into the ink trough, a cover lid 6 is placed thereover.

The cross rail 5 has a clamping strip 7 associated therewith, which can be clamped against the cross rail by recessed Allan head screws or bolts 8. A doctor blade 10, having holes engaged by pins 9, is clamped between the strip 7 and the cross strip 5, and held therein in predetermined position.

In accordance with a feature of the invention, the ink trough further includes a pivotable bottom portion which has, as its major structural component, a holding strip 11, extending parallel to the axis of rotation of the duct roller 2 and along the cross rail 5. The holding rail 11 is formed with bores, for example spaced about 4 cm apart, which are tapped and which receive ink zone adjustment screws 12. The rail 11 is held laterally by bolts 13 which, as will be described below, permit tilting downwardly of the rail 11 and with it the ink zone adjustment screws 12. The rail 11 is held on the cross rail 5 by knurled screws 14. Loosening the screws 14 permits separation of the rail 11 from the cross rail 5 and its pivoting downwardly from the position shown in solid lines to the chain-dotted position 12', until the rail engages a stop element as shown by arrow A.

Figure 2:
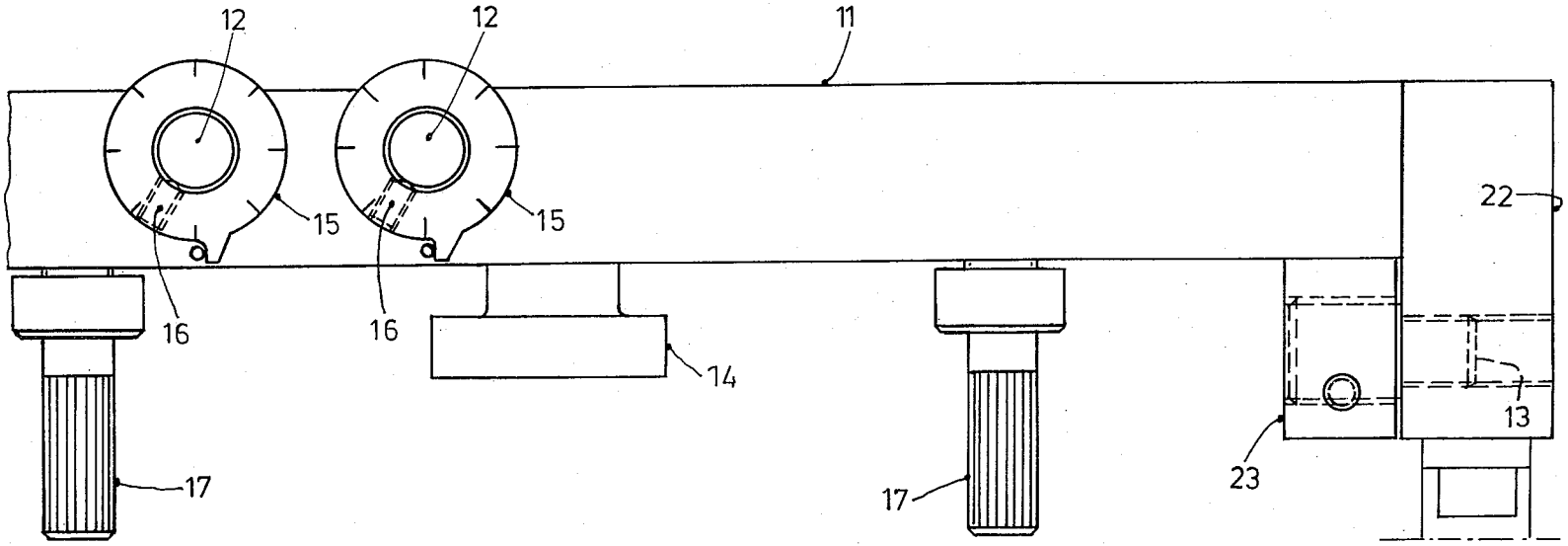
FIG. 2 is a fragmentary end view.

The respective ink zone adjustment screws each have an indicating scale 15 at the outer side thereof (see FIG. 2) to permit reproducible positioning of the screws 12. The scale 15 permits setting of the screw between extreme positions, or to adjust the gap or nip between the doctor blade 10 and the circumference of the duct roller 2 to a predetermined amount, and to reproduce this setting. To prevent unauthorized or random change of the setting, a set screw 16 (FIG. 2) is provided to lock the screw 12 in position.

When the holding rail 11 is in the solid-line position shown in FIG. 1, turning of the ink zone screws 12 permits reproducible adjustment of the gap between the doctor blade 10 and the circumference of the duct roller 2 in order to obtain a suitable thickness of the ink layer which will be carried along on the surface of the roller 2 in respective zones. The adjustment range of the ink adjustment screws 12 is so dimensioned that the gap does not permit substantial escape of the ink even if the screw 12 is in its entire extreme retracted position. An ink cut-off strip 19, extending transversely across the bottom of the doctor blade 10, can be adjusted by the turning one or more override screws 17 which override the zone adjustment setting of the screws 12, so that all ink flow past the duct roller 2 will be stopped. The internal limit position of screw 17 is defined by a set ring 18, which can be locked in position with a set screw and which, in the inner or screwed-in extreme position, bears against the lower surface of the holding rail 11. The screw 17 engages the stop strip 19, which is placed below the doctor blade 10 in the vicinity of the duct roller 2. Rotating the knurled end of screw 17 thus moves the doctor blade 10 by a value limited by the position of the setting ring 18, which is so adjusted that damage to the surface of the duct roller 2 is avoided while, however, still, preventing undesired escape of ink from the ink trough.

Operation, and cleaning: To empty ink from the ink trough 1, for example in order to change the ink, to change ink to a different color or the like, it previously was necessary to remove the entire ink trough. In accordance with the present invention, it is only necessary to loosen the knurled screws 14, which separates the holding rail 11 from the cross rail 5 and permits tipping downwardly of the holding rail 11 and with it the respective ink zone adjustment screws as well as the strip 19 and the screws bearing against it. Tilting or tipping of the holding rail 11 simultaneously lifts off the ends of the screws 12 from engagement with the doctor blade 10. In operating condition, that is, in the full-line condition, the doctor blade 10 is biassed or tensioned against a normally flattened shape as shown in chain-dotted lines in FIG. 1. In normal operating condition, the doctor blade 10 is tensioned away from the chain-dotted position and forms an angle of approximately 20° with the downwardly inclined support or engagement surface of the cross rail 5 which is therebelow. Upon tilting of the holding rail 11, the screws 12 lose contact with the doctor blade 10, which will be relieved from stress and tension and which will tilt or tip downwardly. This will result in a gap between the end of the doctor blade 10 and the surface of the ink duct roller 2. The position of the bolts 13 should be so selected that the width of the gap between the end of the doctor blade 10 and the duct roller 2 is at least about 1 cm, preferably in the order of about 2 cm. This gap permits outflow of the highly viscous printing ink. A drip protecting shield 20 is provided in order to guide the outflowing ink into an ink holding container 21 which can be positioned beneath the ink system. After all the ink has dripped off, the ink trough can be easily cleaned and filled with ink of a different color, or of different type or consistency.

If it is desired only to clean the edge of the doctor blade, only minor lift-off of the rail 11 from the cross rail 5 is needed. Thus, merely loosening the screws 14 will permit such slight tipping. The holding rail 11 is held on both sides by the bolts 13 which may be located in bearings, or journalled within the holding rail. The bearings receiving the bolts 13 can be placed in a bracket 22 (FIG. 2) secured to the cross rail 5 below the duct roller, and in engagement with a further bracket 23 secured to the holding rail 11. The respective brackets can be attached to the cross rail 5 and the holding rail 11, respectively, by screws 25, 24 (FIG. 1), for example.

Figure 3:
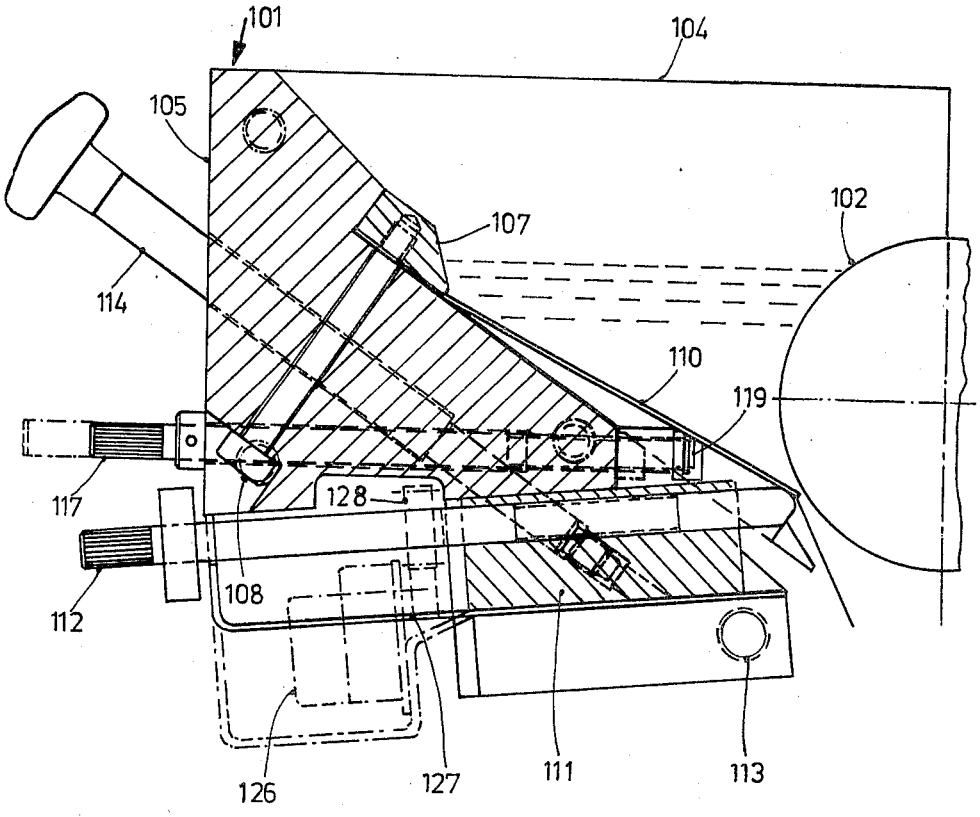
FIG. 3 is a view similar to FIG. 1, illustrating a modified embodiment, in which all parts functionally equivalent to those of FIG. 1 have been given reference numerals incremented by 100 with respect to those of FIG. 1.

Embodiment of FIG. 3: In contrast to the arrangement shown in FIG. 1, the various adjustment screws are relocated so as to be accessible from the side of the ink trough remote from the duct roller, rather than from therebeneath. The elements which are functionally equivalent to those illustrated in connection with FIG. 1 have been given the same reference numerals, incremented by 100. Thus, the screw 114, with a hand grip at the end, is located at an end wall at an easily accessible position, extending from the back side of the cross rail 105 of the ink trough 101, and positioned opposite the ink duct roller 102. The screw 114, with the hand wheel thereon, passes through the cross rail 105 and engages in a suitably bore of the holding strip 111, to permit drawing the holding rail 111 against the cross cross rail 105. The hole in the holding rail 111 can be tapped, and the bolt 114 secured in predetermined position in or against the cross rail 105 by a suitable stop element, a shoulder, as shown, a C-ring, or the like. Tipping the holding rail 111 is done in the same way as in the embodiment of FIG. 1. Screw 114 is retracted, which permits pivoting of the holding rail 111 about pivot bolts 113, to a slight extent if only the edge of the doctor blade 110 is to be cleaned, or to an essentially vertical position if ink is to be drained from the ink trough 101, which is laterally limited by side elements 104. The strip adjustment screws 117 are also located on the same side of the cross rail 105 as the bolts or screws 114. The strip adjustment screws 117 engage a strip or rail 119 to provide an overall bias or engagement position for the doctor blade 110, overriding the individual adjustment by the screws 112, secured to, threaded into, and passing through the holding rail 111.

FIG. 3 additionally illustrates an arrangement in which the various adjustment screws 112 can be remotely controlled. A remote control positioning motor 126 is secured to the holding rail 111, and coupled by a gear drive 127, 128 to the screws 112. Gear 127 is coupled to the motor 126, gear 128 to the screws 112, which can be rotated by remote control of motors 126.

Cleaning and draining of ink: After loosening of the screw 114, the holding strip 111 tips downwardly, pivoting about bolt 113, thus removing the doctor blade 110 from the stressed position, as shown, and leaving a gap between the end of the doctor blade 110 and the surface of the duct roller 102 of sufficient width to permit draining of ink. The doctor blade 110 is held in position, as before, by a holding strip 107 clamped against the cross rail 105 by holding screws 108.

Various changes and modifications may be made, and features described in connection with one of the embodiments may be used with the other, within the scope of the inventive concept.

I claim:

1. Inking trough and doctor blade assembly to supply ink to a printing machine and selectively permit drainage of ink therefrom having an ink duct roller (2, 102);

a cross rail (5, 105) extending parallel to the ink duct roller and spaced therefrom and having a downwardly inclined support surface defining a stationary ink trough;

a doctor blade (10, 110) mounted to engage the duct roller below the center thereof;

means (3, 4, 104) retaining ink in the space above the doctor blade and between the cross rail and the ink duct roller;

and ink zone adjustment screws (12, 112) secured to the cross rail and bearing against the doctor blade and placing the blade in stressed condition;

comprising means (7, 8; 107, 108) for clamping a first end portion of the doctor blade to the cross rail (5);

a movable holding rail (11, 111) extending parallel to the cross rail.

the ink adjustment screws (12, 112) being retained in the holding rail and engaging the doctor blade (10, 110) at a second other end portion;

the ink zone adjustment screws being located for positioning the second end portion of the doctor blade at a stress angle of about 20° when the doctor blade is in operative position relative to the ink duct roller (2, 102) with respect to an unstressed position of the doctor blade along the support surface of the cross rail;

selectively engageable movable attachment means (14, 114) for selectively connecting and positioning the holding rail to the cross rail in selected predetermined position, said attachment means permitting, selectively, movement of the holding rail between an engaged position in which the adjustment screws (12, 112) are oriented with respect to the doctor blade (10, 110) to adjust the nip or gap between the other second end portion of the blade and the duct roller, and disengaged position in which the doctor blade is released from tensioning stress placed thereon by the adjustment screws, and in which the doctor blade is moved away from the duct roller to permit ink to drain out into the resulting gap between the second end portion of the doctor blade and the duct roller, said ink trough remaining stationary during movement of the holding rail;

an ink receiving trough (21) positioned beneath the ink duct roller and located to receive ink draining from the gap between the second end portion of the doctor blade, and the circumference of the ink duct roller;

and wherein the clamping means (7, 107) clamping said first end portion of the doctor blade in position on the cross rail are located to leave a gap of about at least 1 cm width between the end of the doctor blade and the closest surface of the duct roller (2, 102) when the doctor blade is in unstressed, untensioned condition to permit draining of ink from the ink trough through said gap.

2. Assembly according to claim 1, including means (13, 113) pivotally connecting the holding rail (11, 111) to the cross rail (5, 105), said attachment means defining the relative pivot position between said rails.

3. Assembly according to claim 1, including adjustment measuring scales (15) secured to the adjustment screws (12, 112), said scales being rings which define an extreme engagement position of said adjustment screws with respect to the doctor blade and further include indicia to determine the engagement of said screws with the doctor blade and hence the relative position of the doctor blade with respect to the ink duct roller in the zone covered by the respective adjustment screws.

4. Assembly according to claim 1, wherein the attachment means comprises attachment screws (114), and the cross rail (105) is formed with through-bores extending from an essentially vertical surface at an inclination to the holding rail (111), said holding rail being formed with matching, continuing tapped openings to receive said attachment screws.

5. Assembly according to claim 1, further including positioning motor means (126) secured to the holding rail (111);

and drive means (127, 128) transferring positioning rotation from said motor means to the adjustment screws (12, 112).

6. Assembly according to claim 1, further including a shut-off strip (19, 119) extending transversely to the doctor blade in the region adjacent its free end;

and shut-off screws (17, 117) engaging said strip and tending to move said strip towards and away from the doctor blade to provide for rapid movement of the entire end portion of the doctor blade to an ink shut-off position against the ink duct roller, overriding the positioning effect by said adjustment screws.

* * * * *